US011027284B2

(12) United States Patent
Safron et al.

(10) Patent No.: US 11,027,284 B2
(45) Date of Patent: Jun. 8, 2021

(54) WELL PLATE MIXING APPARATUS

(71) Applicant: Thermo Electron Scientific Instruments LLC, Madison, WI (US)

(72) Inventors: Nathaniel S. Safron, Madison, WI (US); Matthew Wayne Meyer, Madison, WI (US); John Magie Coffin, Blue Mounds, WI (US)

(73) Assignee: Thermo Electron Scientific Instruments LLC, Madison, WI (US)

( * ) Notice: Subject to any disclaimer, the term of this patent is extended or adjusted under 35 U.S.C. 154(b) by 365 days.

(21) Appl. No.: 16/215,837

(22) Filed: Dec. 11, 2018

(65) Prior Publication Data

US 2019/0201907 A1 Jul. 4, 2019

Related U.S. Application Data

(60) Provisional application No. 62/611,005, filed on Dec. 28, 2017.

(51) Int. Cl.

| | |
|---|---|
| ***B01L 9/00*** | (2006.01) |
| ***B01F 11/00*** | (2006.01) |
| ***B01L 3/00*** | (2006.01) |

(52) U.S. Cl.

CPC ..... *B01L 9/52* (2013.01); *B01F 11/0022* (2013.01); *B01F 11/0034* (2013.01); *B01L 3/508* (2013.01); *B01F 2215/0037* (2013.01); *B01L 2300/0609* (2013.01); *B01L 2300/0663* (2013.01); *B01L 2300/0809* (2013.01); *B01L 2300/12* (2013.01); *B01L 2300/123* (2013.01); *B01L 2400/043* (2013.01); *B01L 2400/0433* (2013.01)

(58) Field of Classification Search

CPC ..... B01F 11/0022; B01F 11/0034; B01F 2215/0037; B01L 2300/0609; B01L 2300/0663; B01L 2300/0809; B01L 2300/12; B01L 2300/123; B01L 2400/043; B01L 2400/0433; B01L 3/508; B01L 9/52

See application file for complete search history.

(56) References Cited

U.S. PATENT DOCUMENTS

| | | | |
|---|---|---|---|
| 475,848 | A | 5/1892 | Critcher |
| 3,347,531 | A | 10/1967 | Strong et al. |
| 4,102,649 | A | 7/1978 | Sasaki |
| 6,176,609 | B1 | 1/2001 | Cleveland et al. |
| 6,322,240 | B1 | 11/2001 | Omasa |
| 6,508,582 | B2 | 1/2003 | Friedman |
| 6,659,637 | B2 | 12/2003 | Friedman |

(Continued)

FOREIGN PATENT DOCUMENTS

| | | | |
|---|---|---|---|
| EP | 2631007 | A1 | 8/2013 |
| JP | S62234532 | A | 10/1987 |
| RU | 2006107845 | A | 9/2007 |

OTHER PUBLICATIONS

International Search Report and Written Opinion for Application No. PCT/US2018/065088, dated Apr. 18, 2019, 14 pages.

*Primary Examiner* — Jennifer Wecker
*Assistant Examiner* — Jonathan Bortoli

(57) ABSTRACT

A mixing apparatus includes a well plate assembly including a fixed support, and a well movable with respect to the fixed support. A fixed sensor mount has a first portion disposed above the well and a second portion disposed within the well. A plurality of electromagnets are operable to move the well plate assembly vertically with respect to the fixed sensor mount and the fixed support.

28 Claims, 2 Drawing Sheets

(56) References Cited

U.S. PATENT DOCUMENTS

| | | | |
|---|---|---|---|
| 6,988,825 | B2 | 1/2006 | Coville et al. |
| 2002/0044495 | A1 | 4/2002 | Friedman |
| 2016/0121290 | A1 | 5/2016 | Sidhu |
| 2017/0065946 | A1 | 3/2017 | Almassian et al. |

WELL PLATE MIXING APPARATUS

CROSS-REFERENCE TO RELATED APPLICATION

This application claims the benefit of U.S. provisional patent application No. 62/611,005, filed Dec. 28, 2017. The content of this application is incorporated by reference in its entirety.

FIELD OF THE INVENTION

Aspects of this invention relate generally to a mixing apparatus for a well plate, and more particularly, to a mixing apparatus that uses an electromagnet assembly to move a well plate with respect to a fixed sensor mount.

BACKGROUND OF THE INVENTION

Well plates have been and are the industry standard for many types of chemical and biological testing and screenings. Prior art well mixing devices include vibrational plates and orbital motion plates. Changes in the configuration of well plates has decreased the effectiveness of such methods. The density of well plates has transitioned from 48 to 96 to 386 to 1536 wells, drastically decreasing the volume to surface area ratio of each well. As microplate well volumes decrease, variables such as surface tension and the aspect ratio of taller, thinner wells have decreased the effectiveness of traditional mixing techniques. As the diameter of the well decreases, the Reynolds number decreases, resulting in viscous forces becoming more dominant than convective forces in the well, reducing the effectiveness of efforts to mix the contents of the well. Therefore, movement of the well plate is not a sufficient method alone to mix the contents of the well. Pipetting the solution into and out of the well multiple times is effective in mixing the contents of the well, however it is not automated and is not reproducible. Ultrasonic mixing has also been used, but it can introduce heat into the well, which can cause damage to certain molecular species like proteins, DNA, and cells, which are of key interest to many of the well plate studies.

It would be desirable to provide a well mixing apparatus that reduces or overcomes some or all of the difficulties inherent in prior known processes. Particular objects and advantages will be apparent to those skilled in the art, that is, those who are knowledgeable or experienced in this field of technology, in view of the following disclosure and detailed description of certain embodiments.

SUMMARY

In accordance with a first aspect, a mixing apparatus includes a well plate assembly including a fixed support, and a well movable with respect to the fixed support. A fixed sensor mount has a first portion disposed above the well and a second portion disposed within the well. A plurality of electromagnets are operable to move the well plate assembly vertically with respect to the fixed sensor mount and the fixed support.

In accordance with another aspect, an apparatus for mixing a well plate includes a well plate assembly having a fixed support, a base plate having an upper base plate portion spaced from the fixed support and a lower base plate portion spaced from the fixed support, and a well plate including a plurality of wells and movable with respect to the fixed support. Each of a plurality of fixed sensor mounts has a first portion disposed above a selected one of the plurality of wells and a second portion disposed within the selected well. Each of a plurality of sensors is secured to a selected one of the sensor mounts. An electromagnet assembly is operable to move the well plate assembly vertically with respect to the fixed support and the fixed sensor mounts. The electromagnet assembly includes a plurality of electromagnets, each of which includes a magnet housing, an electromagnet fixed in the magnet housing, and a permanent magnet movable with respect to the magnet housing and secured to the base plate. A spring assembly includes a plurality of base plate springs captured between the base plate and the fixed support.

These and additional features and advantages disclosed here will be further understood from the following detailed disclosure of certain embodiments, the drawings thereof, and from the claims.

BRIEF DESCRIPTION OF THE DRAWINGS

The foregoing and other features and advantages of the present embodiments will be more fully understood from the following detailed description of illustrative embodiments taken in conjunction with the accompanying drawings in which.

Figure 1:
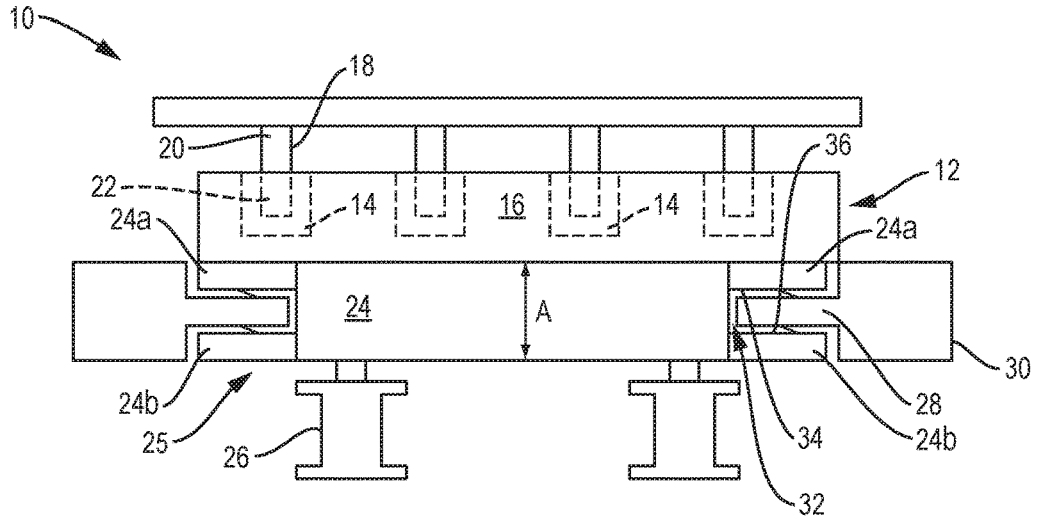
FIG. 1 is an elevation view of a mixing apparatus for a well plate.

The figures referred to above are not drawn necessarily to scale, should be understood to provide a representation of particular embodiments, and are merely conceptual in nature and illustrative of the principles involved. Some features of the mixing apparatus depicted in the drawings have been enlarged or distorted relative to others to facilitate explanation and understanding. The same reference numbers are used in the drawings for similar or identical components and features shown in various alternative embodiments. Mixing apparatuses for well plates as disclosed herein would have configurations and components determined, in part, by the intended application and environment in which they are used.

DETAILED DESCRIPTION OF EMBODIMENTS

FIG. 1 illustrates a representative mixing apparatus 10 that may be used to mix the contents of a well plate assembly 12. Well plate assembly 12 includes one or more wells 14 disposed in a well plate 16. In certain embodiments, well plate 16 may have as many as 1536 and at least 24 wells 14. It is to be appreciated that well plate 16 may include any number of wells 14.

One or more fixed sensor mounts 18 are positioned such that each sensor mount 18 has a first portion 20 disposed above a well 14 and a second portion 22 is disposed within the well 14. As discussed in greater detail below, sensor mounts 18 serve to mix the contents of well 14. In certain embodiments, sensor mounts 18 may be formed of plastic, metal, ceramic, silicon, glass or a PCB.

A base plate 24 is positioned below and in abutting relationship with well plate 16. Well plate 16 and base plate 24 are coupled to one another so that if base plate 24 moves, well plate 16 moves accordingly. They can be coupled by any number of means including gravity acting on well plate 16, a clamp, a fastener, etc. In some embodiments, mixing apparatus 10 is specifically designed to facilitate quick removal and/or replacement of well plate assembly 12.

An electromagnet assembly 25 includes a plurality of electromagnets 26, described in greater detail below, are positioned beneath base plate 24. Electromagnets 26 serve to move well plate assembly 12 with respect to fixed support 30, thereby moving each well 14 with respect to the fixed sensor mount 18 disposed therein. In certain embodiments, well plate assembly 12 moves primarily vertically, or in the Z direction, (as indicated by arrows A) with respect to fixed support 30. It is to be appreciated that in certain embodiments, discussed in greater detail below, electromagnets 26 serve to move well plate assembly 12 horizontally as well, in the X and Y directions.

A portion 28 of a fixed support 30 that surrounds well plate assembly 12 is received in a recess 32 formed into base plate 24 and defining an upper base plate portion 24*a* and a lower base plate portion 24*b*. Portion 28 of fixed support is positioned within recess 30 such that it does not contact well plate assembly 12. Thus, upper base plate portion 24*a* and lower base plate portion 24*b* are each spaced from fixed support 30, allowing movement of base plate 24 and well plate assembly 12 with respect to fixed support 30.

In use, when electromagnets 26 are activated, well plate assembly 12 moves with respect to both fixed support 30 and sensor mounts 18. As wells 14 move with respect to sensor mounts 18, the liquid within wells 14 is mixed not only by the movement of well 14, but also by the movement of sensor mounts 18 within wells 14, as described in greater detail below.

Figure 2:
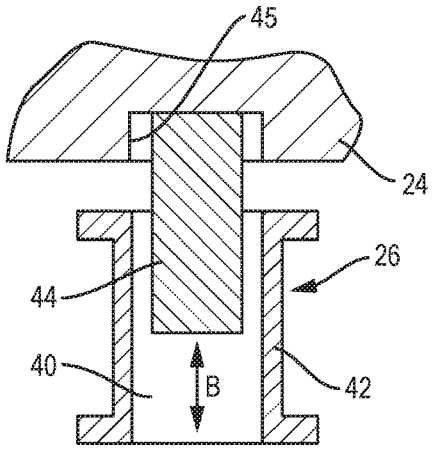
FIG. 2 is a section view, partially broken away, of an electromagnet of the mixing apparatus of FIG. 1.

FIG. 2 illustrates an electromagnet 26 in greater detail. Electromagnet 26 includes an electromagnetic coil 40 disposed within a magnet housing 42. A permanent magnet 44 is positioned partially within magnet housing 42 and partially within a magnet recess 45 formed in a bottom surface of base plate 24. Permanent magnet 44 is secured to base plate 24 such that when permanent magnet 44 moves, it causes well plate 16 and, naturally, well 14 to move as well.

In certain embodiments, electromagnet assembly 25 includes four electromagnets 26 positioned directly beneath base plate 24 and beneath well plate assembly 12, with only two being visible in FIG. 1. It is to be appreciated that electromagnet assembly 25 can include any desired number of electromagnets 26.

Figure 3:
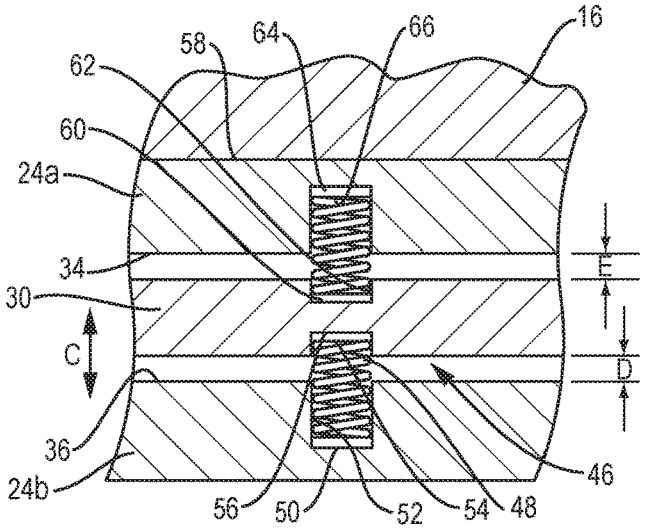
FIG. 3 is a section view, partially broken away, a spring assembly of the mixing apparatus of FIG. 1.

Another portion of electromagnet assembly 25 is shown in FIG. 3, where it can be seen that spring assembly 46 is housed within base plate 24 underneath well plate assembly 12, specifically between upper base plate portion 24*a* and lower base plate portion 24*b*. Spring assembly 46 works with electromagnets 26 to move base plate 24, well plate 16, and wells 14 with respect to fixed support 30. Well plate 16 and wells 14 move primarily vertically, or in the Z direction, (as indicated by arrows C) with respect to fixed support 30 with and against the biasing action of spring assembly 46. As noted above, well plate 16 and wells 14 of well plate assembly 12 can move horizontally as well, in the X and Y directions.

Spring assembly 46 includes a first spring 48 that is captured between lower base plate portion 24*b* and fixed support 30. A first lower end 50 of first spring 48 is seated in a base plate recess 52 formed in an upper surface of lower base plate portion 24*b*. A second upper end 54 of first spring 48 is seated in a first fixed support recess 56 formed in a bottom surface of fixed support 30.

A second spring 58 is captured between upper base plate portion 24*a* and fixed support 30. A first lower end 60 of second spring 58 is seated in a second fixed support recess 62 formed in an upper surface of fixed support 30. A second upper end 64 of second spring 58 is seated in a well plate recess 56 formed in a bottom surface of upper base plate portion 24*a*.

First spring 48 is configured to keep base plate 24 spaced apart a first distance D from fixed support 30 when well plate assembly 12 is in an at rest condition. Similarly, second spring 58 is configured to keep well plate 16 spaced apart from fixed support 30 a second distance E when well plate assembly 12 is in an at rest condition. Distances D and E are the maximum distances that well plate 16 and upper and lower base plate portions 24*a*, 24*b* can move up and down, respectively, in the vertical, or Z, direction. In certain embodiments, distances D and E are each approximately 0.5 mm, providing for a total vertical travel distance for well plate assembly 12 and, therefore, wells 14, of approximately 1 mm.

The term "approximately" as used herein is meant to mean close to, or about a particular value, within the constraints of sensible, commercial engineering objectives, costs, manufacturing tolerances, and capabilities in the field of mixing apparatus manufacturing and use. Similarly, the term "substantially" as used herein is meant to mean mostly, or almost the same as, within the constraints of sensible, commercial engineering objectives, costs, manufacturing tolerances, and capabilities.

When electromagnet 26 is activated, electromagnetic coil 40 is alternately energized and de-energized, alternately moving permanent magnet 44, and therefore, well plate assembly 12, toward and away from electromagnetic coil 40 and magnet housing 42 against the biasing actions of first spring 48 and second spring 58 in the direction of arrows A seen in FIG. 1 and arrows B seen in FIG. 2.

Figure 4:
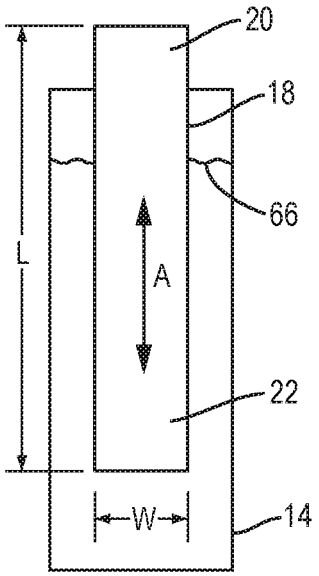
FIG. 4 is a schematic front elevation view of a sensor mount in a well of the mixing apparatus of FIG. 1.
Figure 5:
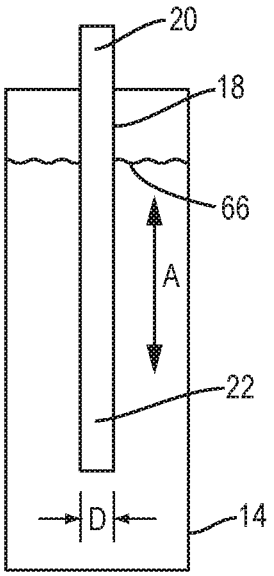
FIG. 5 is a schematic side elevation view of a sensor mount in a well of the mixing apparatus of FIG. 1.
Figure 6:
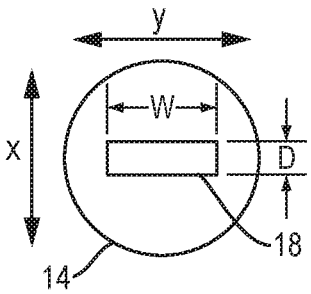
FIG. 6 is a plan view of a sensor mount in a well of the mixing apparatus of FIG. 1.

This cycling or oscillating of electromagnet 26 causes the vertical movement of well plate assembly 12 and, therefore wells 14, which can be seen more clearly in FIGS. 4-6. Wells 14 include liquid with contents to be sensed, as denoted by liquid level line 66. As well 14 moves vertically in the direction of arrows A, sensor mount 18 is stationary causing relative movement compared to well 14, such that second portion 22 of sensor mount 18, which is disposed within the liquid, mixes the contents of well 14. In certain embodiments, electromagnet 26 may oscillate at a rate of approximately 30 Hz.

In certain embodiments, the plurality of electromagnets 26 all operate simultaneously in phase so that well plate assembly 12 and wells 14 move only vertically in the Z direction. In other embodiments, electromagnets 26 may operate out of phase with one another. In such an embodiment, well plate assembly 12 and wells 14 do not move only vertically. Rather, in such an embodiment, well plate assembly 12 and wells 14 move with a rocking or orbital motion, providing movement horizontally in the X and Y directions (seen in FIG. 6) as well as vertically in the Z direction. It is to be appreciated, however, that in such an embodiment, well plate assembly 12 and wells 14 move primarily vertically in the Z direction. In other words, in such an embodiment, well plate assembly 12 and wells 14 move a larger distance vertically in the Z direction than they move horizontally in the X and Y directions.

The relative movement of well 14 with respect to stationary sensor mount 18 creates two types of mixing of the fluid in well 14. The first type of mixing is shear mixing that occurs along the surface of sensor mount 18. This shear mixing is caused by the no-slip boundary condition that occurs at the interface of the liquid in well 14 and sensor mount 18. The liquid next to sensor mount 18 moves at the same velocity as the stationary sensor mount, while the liquid in the rest of well 14 moves at the same velocity as well 14, creating a large velocity gradient in the liquid of well 14. The large velocity gradient in the liquid is the best condition for mixing. Since the large velocity gradient and, therefore, the best mixing conditions are next to the surface of sensor mount 18, this mixing is especially useful for the addition of certain molecular species from sensor mount 18 to the contents of well 14, or for movement of a molecular species from well 14 to the surface of sensor mount 18. In a preferred embodiment, sensor mount 18 may be used for sensing of the concentration of the molecular species next to sensor mount 18. In this case, the purpose of mixing is so that the rate any change in the species concentration at the surface is limited by reaction kinetics, not diffusion kinetics.

The second kind of mixing is due to the liquid displaced by the volume of sensor mount 18, which will cause large scale displacement currents and eddies in well 14, greatly increasing the rate of mixing. These displacement currents are useful for mixing the entirety of well 14. Both of these types of mixing will equilibrate the concentration of molecular species throughout the entirety of well 14.

The combination of positioning sensor mount 18 in well 14 and the mostly vertical motion of well 14 relative to sensor mount 18 provides good, thorough, and efficient mixing. Without sensor mount 18, or another nonmoving object in well 14, there will be no shear mixing and no displacement mixing within well 14. Merely creating vertical movement of well 14 through the operation of electromagnets 16 will not thoroughly mix the contents of well 14. At the same time, without the predominantly vertical motion of well 14, there will also not be thorough mixing of the contents of well 14 since there will be no velocity gradient near the surface of sensor mount 18. In such a case, only diffusion could equilibrate the molecular species concentration from near the surface of sensor mount 18 to the rest of well 14.

The use of sensor mount 18 in conjunction with electromagnet assembly 25 to mix the contents of well 14 provides an easy to use and highly repeatable way of thoroughly mixing the contents of well 14. Further, such a mixing apparatus imparts low levels of energy to the contents of well 14, thereby decreasing the chance of damaging the contents of well 14.

It has been discovered that the use of sensor mount 18 in conjunction with electromagnet assembly 25 to mix the contents of well 14 is much more effective than the mixing of well 14 would be when using electromagnet assembly 25 alone. In one experiment it was found that thorough mixing to reach equilibrium in well 14 using just electromagnet assembly 25 (which provides only movement of well 14) took approximately one hour, while equilibrium was reached in well 14 using both sensor mount 18 and electromagnet assembly 25 (which provides movement of well 14, shear mixing, and displacement) within approximately 3 seconds. This provides a greater than 1000× improvement using both sensor mount and electromagnet assembly 25 as compared to using electromagnet assembly 25 alone.

In the embodiment illustrated in FIGS. 4-6, sensor mount 18 has the shape of an elongate plate. Thus, in such an embodiment sensor mount 18 has a length L, a width W, and a depth D, where the length L is significantly larger than the width W, and the width W is significantly larger than the depth D. This produces a relatively thin and long plate, providing a large ratio of surface area to volume for sensor mount 18, which enhances the mixing capability of sensor mount 18 within well 14.

In certain embodiments, sensor mount 18 has a length L of between approximately 2 mm and approximately 10 mm a width W of between approximately 1 mm and approximately 15 mm, and a depth of between approximately 0.2 mm and approximately 3.2 mm. Well 14 may have a diameter of between approximately 1.7 mm and approximately 15.6 mm, and a height of between approximately 4.8 mm and approximately 11.0 mm.

In another embodiment for a standard 96 well plate, sensor mount 18 has a length L of between approximately 6 mm and approximately 12 mm, a width W of between approximately 4.8 mm and approximately 5.2 mm, and a depth of between approximately 1.4 mm and approximately 1.8 mm. Well 14 may have a diameter of between approximately 6.0 mm and approximately 7.0 mm, and a height of between approximately 10.0 mm and approximately 11.0 mm.

Figure 7:
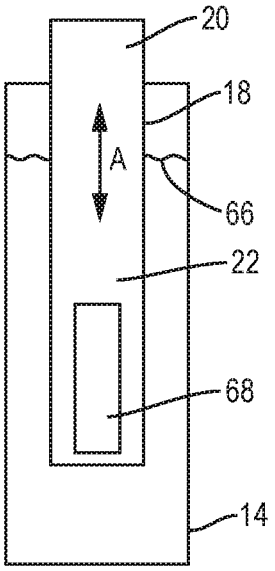
FIG. 7 is a schematic front elevation view of an alternative embodiment of a sensor mount in a well of the mixing apparatus of FIG. 1.
Figure 8:
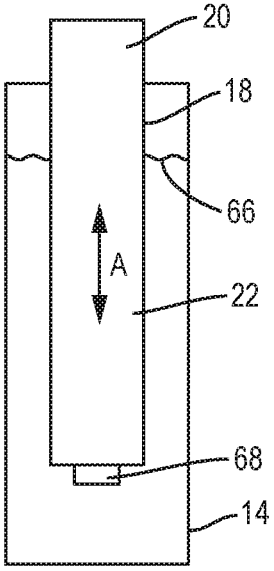
FIG. 8 is a schematic front elevation view of another alternative embodiment of a sensor mount in a well of the mixing apparatus of FIG. 1.

Another embodiment of sensor mount 18 can be seen in FIG. 7, in which a sensor 68 is secured to a side surface of sensor mount 18. In another embodiment, as seen in FIG. 8, sensor 68 could be secured to a bottom surface of sensor mount 18. It is to be appreciated that in the embodiment of FIG. 8, sensor mount 18 could have a cylindrical shape, and sensor 68 could have a circular shape.

Sensor 68 may be, in certain embodiments, a graphene or a carbon nanotube sensor, e.g., a functionalized graphene or carbon nanotube substrate. Such a graphene or a carbon nanotube sensor can detect changes in conductance when a target analyte or plurality of target analytes contact the functionalized graphene or carbon nanotube substrate.

In certain embodiments, such a carbon nanotube substrate includes semiconducting single walled carbon nanotubes (s-SWCNTs). Such s-SWCNTs are characterized by a high surface area and semiconducting properties sufficient to produce a scalable sensitivity. In certain embodiments the carbon nanotube substrate may be planar. The carbon nanotube substrate may be a carbon nanotube semiconductor surface fashioned into a biosensor device that monitors electrical field charge carriers across the semiconductor material's surface. When binding events from biomolecular interactions occur and are coupled with the surface of the carbon nanotubes, the carrier concentration on the nanotube can change, which changes the conductivity. As target analytes bind to the functionalized nanotube surface, the current is altered and detected. In certain embodiments, the binding interaction occurs within the Debye screening length in order for the interaction to be detected. To enhance the sensitivity, small receptors such as fragmented antibodies, can be used.

The carbon nanotubes can be single walled carbon nanotubes known to those of skill in the art and generally used for the manufacture of carbon nanotube substrates. Carbon nanotubes (CNTs), as are known in the art, are allotropes of carbon with a generally cylindrical nanostructure. In general, carbon nanotubes are characterized by a hollow cylindrical structure of given length with the walls formed by one-atom-thick sheets of carbon, called graphene. In general, graphene sheets are rolled or otherwise configured at specific and discrete ("chiral") angles, and the combination of the rolling angle and radius decides the nanotube properties, for example, whether the individual nanotube shell is a metal or semiconductor. Nanotubes are categorized as single-walled nanotubes (SWCNTs) and multi-walled nanotubes (MWCNTs). Individual nanotubes can naturally align themselves into "ropes" held together by van der Waals forces, more specifically, pi-stacking. Exemplary single-walled carbon nanotubes (SWCNTs) have a diameter of about 1-2 nanometer, but can be wider. According to one aspect, SWCNTs can exhibit a band gap from zero to about 2 eV and their electrical conductivity can show metallic or semiconducting behavior. Single-walled carbon nanotubes provide exemplary substrates for the detection devices described herein. A more detailed description of exemplary single-walled carbon nanotubes and methods of their manufacture are described in U.S. application Ser. No. 16/155,955, filed on Oct. 10, 2018, and entitled "Carbon Nanotube-Based Device for Sensing Molecular Interaction," the entire disclosure of which is incorporated herein by reference in its entirety for all purposes. Exemplary carbon nanotubes for use in devices are also described in U.S. Pat. Nos. 7,416,699, 6,528,020, and 7,166,325 each of which is hereby incorporated by reference in its entirety.

Those having skill in the art, with the knowledge gained from the present disclosure, will recognize that various changes can be made to the disclosed apparatuses and methods in attaining these and other advantages, without departing from the scope of the present invention. As such, it should be understood that the features described herein are susceptible to modification, alteration, changes, or substitution. For example, it is expressly intended that all combinations of those elements and/or steps which perform substantially the same function, in substantially the same way, to achieve the same results are within the scope of the invention. Substitutions of elements from one described embodiment to another are also fully intended and contemplated. The specific embodiments illustrated and described herein are for illustrative purposes only, and not limiting of the invention as set forth in the appended claims. Other embodiments will be evident to those of skill in the art. It should be understood that the foregoing description is provided for clarity only and is merely exemplary. The spirit and scope of the present invention are not limited to the above examples, but are encompassed by the following claims. All publications and patent applications cited above are incorporated by reference in their entirety for all purposes to the same extent as if each individual publication or patent application were specifically and individually indicated to be so incorporated by reference.

What is claimed is:

1. An apparatus for mixing a well plate comprising:

a well plate assembly including a fixed support, and a well movable with respect to the fixed support;

a fixed sensor mount having a first portion disposed above the well and a second portion disposed within the well; and a plurality of electromagnets operable to move the well plate assembly vertically with respect to the fixed sensor mount and the fixed support.

2. The apparatus of claim 1, wherein each electromagnet comprises:

an electromagnetic coil fixed in a magnet housing;

a permanent magnet movable with respect to the magnet housing and secured to the well plate assembly; and a spring assembly disposed between the well plate assembly and the fixed support.

3. The apparatus of claim 2, wherein the electromagnet assembly comprises:

a plurality of additional electromagnets; and a plurality of additional spring assemblies disposed between the well plate assembly and the fixed support.

4. The apparatus of claim 3, wherein the plurality of electromagnets operate simultaneously in phase.

5. The apparatus of claim 3, wherein the plurality of electromagnets operate out of phase so as to move the well both vertically and horizontally.

6. The apparatus of claim 5, wherein the well moves a longer distance vertically than it moves horizontally.

7. The apparatus of claim 2, wherein the spring assembly comprises:

a first spring captured between the well plate assembly and a lower surface of the fixed support; and a second spring captured between the well plate assembly and an upper surface of the fixed support.

8. The apparatus of claim 7, wherein the well plate assembly comprises:

a base plate; and a well plate, wherein the well is disposed in the well plate, wherein at least one portion of the base plate is spaced from the fixed support.

9. The apparatus of claim 8, wherein the base plate comprises a lower base plate portions positioned below the fixed support and an upper base plate portion positioned above the fixed support, wherein the first spring comprises an upper base plate spring positioned between the upper base plate portion and the fixed support, and wherein the second spring comprises a lower base plate spring positioned between the lower base plate portion and the fixed support.

10. The apparatus of claim 1, further comprising a plurality of additional sensor mounts, wherein the well plate assembly includes a plurality of wells, each additional sensor mount having a first portion disposed above one of the wells and a second portion disposed within the one of the wells.

11. The apparatus of claim 1, wherein the electromagnet assembly oscillates at approximately 30 Hz.

12. The apparatus of claim 1, wherein the electromagnet assembly is configured to vertically displace the well approximately 1 mm.

13. The apparatus of claim 1, wherein the sensor mount has a first portion disposed above the well and a second portion disposed within the well.

14. The apparatus of claim 1, wherein the sensor mount is formed of one of plastic, metal, ceramic, silicon, glass and a PCB.

15. The apparatus of claim 1, further comprising a sensor secured to the sensor mount.

16. The apparatus of claim 15, wherein the sensor is secured to one of a side and the bottom of the sensor mount.

17. The apparatus of claim 15, wherein the sensor is a carbon nanotube sensor.

18. The apparatus of claim 1, wherein the sensor mount has the shape of an elongate plate.

19. An apparatus for mixing a well plate comprising:

a well plate assembly comprising:

a fixed support;

a base plate having an upper base plate portion spaced from the fixed support and a lower base plate portion spaced from the fixed support; and a well plate including a plurality of wells, having a portion spaced from the fixed support, and being movable with respect to the fixed support;

a plurality of fixed sensor mounts, each sensor mount having a first portion disposed above a selected one of the plurality of wells and a second portion disposed within the selected well;

a plurality of sensors, each sensor secured to a selected one of the sensor mounts;

an electromagnet assembly operable to move the well plate assembly vertically with respect to the fixed support and the fixed sensor mounts, the electromagnet assembly comprising:

a plurality of electromagnets, each electromagnet comprising:

a magnet housing;

an electromagnet fixed in the magnet housing; and a permanent magnet movable with respect to the magnet housing and secured to the base plate; and a spring assembly comprising:

a plurality of base plate springs captured between the base plate and the fixed support.

20. The apparatus of claim 19, wherein the plurality of electromagnets operate simultaneously in phase.

21. The apparatus of claim 19, wherein the plurality of electromagnets operate out of phase so as to move the wells both vertically and horizontally.

22. The apparatus of claim 21, wherein the wells move a longer distance vertically than they moves horizontally.

23. The apparatus of claim 19, wherein the electromagnets oscillate at approximately 30 Hz.

24. The apparatus of claim 19, wherein the electromagnet assembly is configured to vertically displace the well approximately 1 mm.

25. The apparatus of claim 19, wherein each sensor mount is formed of one of plastic, metal, ceramic, silicon, glass and a PCB.

26. The apparatus of claim 19, wherein each sensor is secured to one of a side and the bottom of the selected sensor mount.

27. The apparatus of claim 19, wherein each sensor is a carbon nanotube sensor.

28. The apparatus of claim 19, wherein each sensor mount has the shape of an elongate plate.

* * * * *